US005678436A

United States Patent [19]

Alexander

[11] Patent Number: 5,678,436

[45] Date of Patent: Oct. 21, 1997

[54] REMOTE CONTROL DOOR LOCK SYSTEM

[76] Inventor: Curtis Earl Alexander, P.O. Box 210102, Dallas, Tex. 75228

[21] Appl. No.: 563,611

[22] Filed: Nov. 28, 1995

[51] Int. Cl.[6] ..... E05B 49/00

[52] U.S. Cl. ..... 70/278; 70/256; 70/456 R

[58] Field of Search ..... 70/278, 277–279, 70/283, 256, 446, DIG. 14, 408, 456 R; 292/144

[56] References Cited

U.S. PATENT DOCUMENTS

| | | | |
|---|---|---|---|
| 3,234,766 | 2/1966 | O'Brien | 292/144 |
| 3,733,861 | 5/1973 | Lester | 70/153 |
| 4,225,164 | 9/1980 | Wensley et al. | 292/33 |
| 4,227,386 | 10/1980 | Crockett | 70/118 |
| 4,438,962 | 3/1984 | Soloviff et al. | 292/144 |
| 4,557,124 | 12/1985 | Russ | 70/456 R |
| 4,800,741 | 1/1989 | Kerschenbaum et al. | 70/13 |
| 4,905,490 | 3/1990 | Wilson | 70/442 |
| 4,907,429 | 3/1990 | Davis et al. | 70/279 |
| 5,184,491 | 2/1993 | Schittenhelm | 70/278 |
| 5,199,288 | 4/1993 | Meriläinon et al. | 70/279 |
| 5,261,260 | 11/1993 | Lin | 70/280 |
| 5,386,713 | 2/1995 | Wilson | 70/280 |
| 5,531,086 | 7/1996 | Bryant | 70/279 |

*Primary Examiner*—Steven N. Meyers
*Assistant Examiner*—Donald J. Lecher
*Attorney, Agent, or Firm*—Joseph N. Breaux

[57] ABSTRACT

A remote control door lock system connectable to a door about a deadbolt lock for remotely unlocking or locking the deadbolt is provided. The remote control door lock system comprises: a housing mountable to a door about a deadbolt lock; an electric motor having a motor shaft mounted within the housing, the motor shaft being directed toward the deadbolt lock; a key frame rigidly connected to the motor shaft, the key frame is adapted for holding a deadbolt key, the key is operationally insertable into the deadbolt lock; a receiver switch mechanism in connection with the electric motor for selectively operating the electric motor; a power source in connection with the switching mechanism and the electric motor; and a remote transmitter adapted to send a signal to the receiver switch for selectively operating the motor in a direction turning the key frame and the key in a direction to operate the deadbolt lock.

7 Claims, 1 Drawing Sheet

REMOTE CONTROL DOOR LOCK SYSTEM

TECHNICAL FIELD

The present invention relates to devices for remotely locking or unlocking a door and more particularly to devices for remotely locking or unlocking a door that is connectable to a conventional deadbolt lock or door lock.

BACKGROUND ART

The physically handicapped and other disabled individuals often are faced with the need to unlock a normally locked door, as for example the front door of a home, when that individual is in a remote location, such as a bedroom, in the home. Clearly, here has, heretofore, been needed a mechanism to enable such a disabled individual, or simply anyone who is unwilling to move from the remote location, to unlock and/or lock the door lock of a home or business. With the increase in crime in residential neighborhoods it is also needed to have a mechanism for remotely unlocking a door without spending unnecessary time outside.

It would be a benefit, therefore, to have a device for remotely unlocking/locking a door that is connectable to a conventional lock. It would be a further benefit to have a device that has a power source which may be recharged without having to remove the device from the lock. It would be a further benefit, to have a device which is connectable to a conventional key inserted into the lock.

GENERAL SUMMARY DISCUSSION OF INVENTION

It is thus an object of the invention to provide a remote control door lock system that has a housing mountable to a door about a conventional lock.

It is a further object of the invention to provide a remote control door lock system that has an electric motor mounted within the housing having a key frame connected to the motor shaft for turning a key inserted into the lock for locking or unlocking the lock, the electric motor being operable by a remote transmitter.

It is a still further object of the invention to provide a remote control door lock system that has a rechargeable battery pack as a power source, the battery pack being rechargeable within the housing.

It is a still further object of the invention to provide a remote control door lock system that has a manual locking switch and unlocking switch.

Accordingly, a remote control door lock system connectable to a door about a deadbolt lock for remotely unlocking or locking the deadbolt is provided. The remote control door lock system comprises: a housing mountable to a door about a deadbolt lock; an electric motor having a motor shaft mounted within the housing, the motor shaft being directed toward the deadbolt lock; a key frame rigidly connected to the motor shaft, the key frame is adapted for holding a deadbolt key, the key is operationally insertable into the deadbolt lock; a receiver switch mechanism in connection with the electric motor for selectively operating the electric motor; a power source in connection with the switching mechanism and the electric motor; and a remote transmitter adapted to send a signal to the receiver switch for selectively operating the motor in a direction turning the key frame and the key in a direction to operate the deadbolt lock.

The housing is constructed of a substantially rigid material such as metal or plastic. The housing may be of a unitary construction. The housing may be constructed in two halves hingedly connected to facilitate accessing the interior of the housing.

The key frame is rigidly connected to the motor shaft so that when the motor shaft rotates the key frame does not flex with the key inserted into the lock. The key frame is constructed in a manner such that a key may be removably held therein.

The electric motor is a low torque motor well known in the art. The electric motor is capable of turning the motor shaft in a clockwise and a counter clockwise direction. The motor has limit switches to turn the motor off when the key has been turned a sufficient distance to lock or unlock the deadbolt.

In a preferred embodiment the power source is a rechargeable battery pack. More preferably, the rechargeable battery pack has a mechanism for connecting an electrical source to the pack so as to be able to recharge the battery pack while contained within the housing.

The remote control door lock system may further include manual switches to allow the deadbolt to be locked or unlocked without use of the remote transmitter. A system of lights may be included to indicate whether the deadbolt is in a locked or unlocked position.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
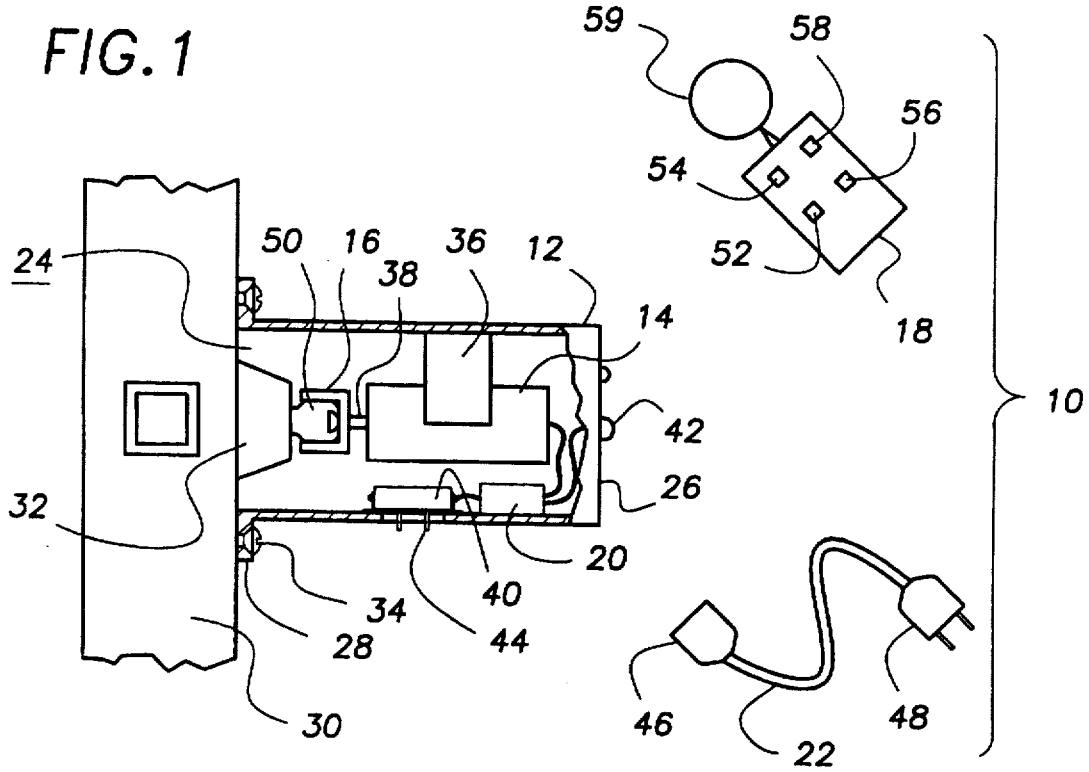
FIG. 1 is a partial cross-sectional, side view of the remote control door lock system of the present invention.

FIG. 1 is a partial cross-sectional, side view of the remote control door lock system of the present invention generally designated by the numeral 10. System 10 includes a housing 12, an electric motor 14, a key frame 16, a remote transmitter 18, a receiver switch 20 and a power cord 22.

Housing 12 is a metal tubular member having an open end 24 and a cover end 26. Two foot members 28 extend perpendicularly outward from open end 24. Housing 12 is mountable to a door 30 about a conventional deadbolt 32 by disposing screws 34 through foot members 28 into door 30.

Electric motor 14 is rigidly mounted substantially concentrically within housing 12 by a brace 36. Electric motor 14 has a motor shaft 38 directed toward open end 24 of housing 12 and deadbolt lock 32. Motor 14 is operationally connected to receiver switch 20 mounted within housing 12. Receiver switch 20 is a switching mechanism for selectively operating motor 14. Receiver switch 20 is controllable by a signal received from remote transmitter 18. Motor 14 is also operationally connected to a manual lock switch 42 and a manual unlock switch (not shown).

Receiver switch 20 and motor 14 are functionally connected to a rechargeable battery pack 40 mounted within housing 12. Rechargeable battery pack 40 has a male electrical connector 44 extending through housing 12. Male connector 44 is connectable to a female connector end 46 of power cord 22. Power cord 22 has a male connector end 48 for attaching to a wall socket (not shown).

Key frame 16 is rigidly connected to motor shaft 38. Key frame 38 is adapted for holding a deadbolt key 50 with key 50 operationally inserted into deadbolt lock 32.

Remote transmitter 18 is a conventional transmitter adapted to send a signal to receiver switch 20 for selectively operating motor 14. Remote transmitter 18 has a first button 52 for pressing to send a signal to receiver switch 20 operating motor 14 in a direction to turn key 50 to lock deadbolt 32. A red light 54 is turned on when button 52 has been pressed indicating that deadbolt 32 is in the locked position. Remote transmitter 18 has a second button 56 for pressing to send a signal to receiver switch 20 operating motor 14 in a direction to turn key 50 to unlock deadbolt 32. A green light 58 is turned on when button 56 is pressed indicating that deadbolt 32 is in the unlocked position. Transmitter 18 further has a key ring connected thereto.

Figure 2:
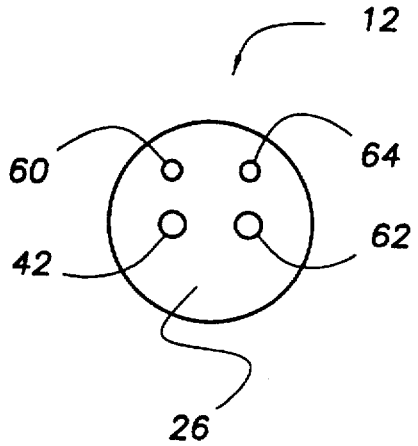
FIG. 2 is a front view of the housing showing the cover end.

FIG. 2 is a front view of housing 12 showing cover end 26. Manual lock switch 42 extends through cover end 26 for pressing to operate motor 14 in a direction to lock deadbolt 32. A first red light 60 is turned on when lock switch 42 is pressed. Manual unlock switch 62 extends through cover end 26 for pressing to operate motor 14 in a direction to unlock deadbolt 32. A green light 64 is turned on when unlock switch 62 is pressed.

Figure 3:
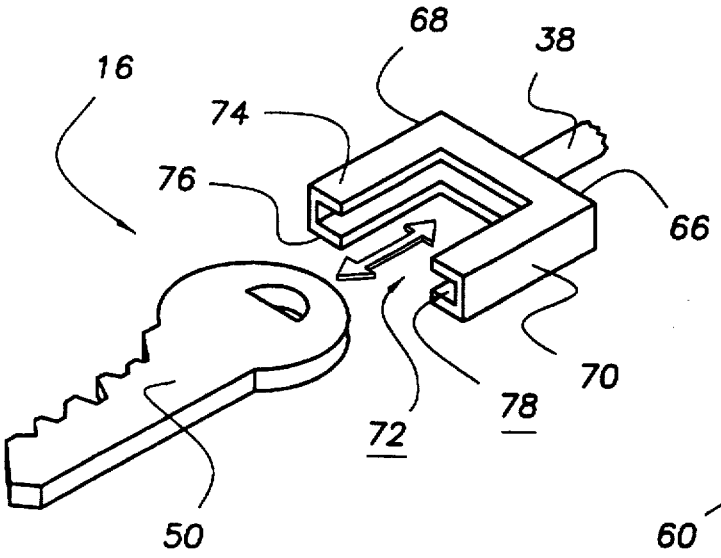
FIG. 3 is a perspective view of the key frame in isolation.

FIG. 3 is a perspective view of key frame 16 in isolation. Key frame 16 has a lateral arm 66 and a first and second arm 68, 70. First and second arm 68, 70 are spaced substantially parallel to one another and extend substantially perpendicularly from lateral arm 66 to define a U-shaped cavity 72. A first flap 74 extends from a periphery of arms 66, 68 and 70 into U-shaped cavity 72. A second flap 76 extends from an opposite periphery of arms 66, 68 and 70 into U-shaped cavity 72. Flaps 74 and 76 and arms 66, 68 and 70 define a keyway 78 for removable holding deadbolt key 50 therein. Motor shaft 38 is rigidly connected to lateral arm 66 approximate the midpoint thereof.

Key frame 16 is constructed of a substantially rigid, resilient plastic. First and second arm 68 and 70 may be urged apart so as to allow for the placement of key 50 therebetween in a manner such that key 50 is rigidly held therebetween. Flaps 74 and 76 are spaced such that to insert key 50 within keyway 78 flaps 74, 76 must be urged apart thus gripping key 50 when inserted therein.

Use of remote control door lock system 10 is now described with reference to FIGS. 1 through 3. First, key 50 is inserted within U-shaped cavity 72 and keyway 78 of key frame 16 such that key 50 is rigidly held therein. Key 50 is then inserted into deadbolt 32 and housing 12 is connected to door 30 by screws 34. Deadbolt 32 may then be locked by either pressing first button 52 on transmitter 18 or by pressing lock switch 42 extending through cover end 26 of housing 12. In locking deadbolt 32 motor 14 turns key frame 16 and key 50 until deadbolt 32 is in the locked position at which point a limit switch cuts motor 14 off. To unlock deadbolt 32 the same process is performed by process either second button 56 or unlock switch 62. When rechargeable battery pack 40 deteriorates, pack 40 may be connected with an electrical source via power cord 22 to recharge pack 40.

It can be seen from the preceding description that a device for remotely locking or unlocking a door which has a housing mountable to a door about a conventional lock, has an electric motor mounted within the housing having a key frame connected to the motor shaft for turning a key inserted into the lock for locking or unlocking the lock, the electric motor being operable by a remote transmitter, has a rechargeable battery pack as a power source, the battery pack being rechargeable within the housing, and has a manual locking switch and unlocking switch has been provided.

It is noted that the embodiment of the remote control door lock system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A remote control door lock system comprising:

a housing mountable to a door about a deadbolt lock;

an electric motor having a motor shaft mounted within said housing, said motor shaft being directed toward said deadbolt lock;

a key frame rigidly connected to said motor shaft, said key frame being adapted for holding a deadbolt key, said key being operationally insertable into said deadbolt lock;

a receiver switch mechanism in connection with said electric motor for selectively operating said electric motor;

a power source in connection with said switching mechanism and said electric motor; and remote transmitter adapted to send a signal to said receiver switch for selectively operating said motor in a direction turning said key frame and said key in a direction to operate said deadbolt lock;

said key frame including a lateral arm, a first arm and a second arm, said first and said second arm being spaced substantially parallel to one another and extending substantially perpendicularly from said lateral arm to define a U-shaped cavity, said motor shaft being rigidly connected to said lateral arm approximate the midpoint thereof;

said key frame being constructed of a substantially rigid, resilient material whereby said first and said second arm may be urged away from one another for inserting said deadbolt key into said U-shaped cavity in a manner such that said key is rigidly held therebetween.

2. The remote control door lock system of claim 1, wherein:

said key frame further includes:

a first flap extending from a periphery of said arms into said U-shaped cavity; and a second flap extending from an opposite periphery of said arms into said U-shaped cavity;

said first flap, said second flap and said arms defining a key way for disposing said key in a manner such that said flaps grip said key.

3. A remote control door lock system comprising:

a housing mountable to a door about a deadbolt lock;

an electric motor having a motor shaft mounted within said housing, said motor shaft being directed toward said deadbolt lock;

a key frame rigidly connected to said motor shaft, said key frame being adapted for holding a deadbolt key, said key being operationally insertable into said deadbolt lock;

a receiver switch mechanism in connection with said electric motor for selectively operating said electric motor;

a rechargeable battery pack in connection with said switching mechanism and said electric motor, said battery pack having a male electrical connector extending through said housing adapted for connecting to an electrical source for recharging said rechargeable battery pack;

a remote transmitter adapted to send a signal to said receiver switch for selectively operating said motor in a direction turning said key frame and said key in a direction to operate said deadbolt lock;

a manual lock switch operationally connected to said motor for operating said motor in a direction turning said key frame and said key in a direction moving said deadbolt lock into a locked position; and a manual unlock switch operationally connected to said motor for operating said motor in a direction turning said key frame and said key in a direction moving said deadbolt lock into an unlocked position;

said key frame including a lateral arm, a first arm and a second arm, said first and said second arm being spaced substantially parallel to one another and extending substantially perpendicularly from said lateral arm to define a U-shaped cavity, said motor shaft being rigidly connected to said lateral arm approximate the midpoint thereof;

said key frame being constructed of a substantially rigid, resilient material whereby said first and said second arm may be urged away from one another for inserting said deadbolt key into said U-shaped cavity in a manner such that said key is rigidly held therebetween.

4. The remote control door lock system of claim 3, wherein:

said key frame further includes:

a first flap extending from a periphery of said arms into said U-shaped cavity; and a second flap extending from an opposite periphery of said arms into said U-shaped cavity;

said first flap, said second flap and said arms defining a key way for disposing said key in a manner such that said flaps grip said key.

5. The remote control door lock system of claim 4, further including:

a power cord having a female connector end connectable to said male electrical connector of said rechargeable battery pack and a male connector end connectable to an electrical source for recharging said rechargeable battery pack.

6. A remote control door lock system comprising:

a housing mountable to a door about a deadbolt lock;

an electric motor having a motor shaft mounted within said housing, said motor shaft being directed toward said deadbolt lock;

a key frame rigidly connected to said motor shaft, said key frame being adapted for holding a deadbolt key, said key being operationally insertable into said deadbolt lock;

a receiver switch mechanism in connection with said electric motor for selectively operating said electric motor;

a rechargeable battery pack in connection with said switching mechanism and said electric motor, said battery pack having a male electrical connector extending through said housing adapted for connecting to an electrical source for recharging said rechargeable battery pack;

a remote transmitter adapted to send a signal to said receiver switch for selectively operating said motor in a direction turning said key frame and said key in a direction to operate said deadbolt lock;

a manual lock switch operationally connected to said motor for operating said motor in a direction turning said key frame and said key in a direction moving said deadbolt lock into a locked position; and a manual unlock switch operationally connected to said motor for operating said motor in a direction turning said key frame and said key in a direction moving said deadbolt lock into an unlocked position;

wherein said key frame includes:

a lateral arm, a first arm and a second arm, said first and said second arm being spaced substantially parallel to one another and extending substantially perpendicularly from said lateral arm to define a U-shaped cavity, said motor shaft being rigidly connected to said lateral arm approximate the midpoint thereof;

a first flap extending from a periphery of said arms into said U-shaped cavity;

a second flap extending from an opposite periphery of said arms into said U-shaped cavity; and said first flap, said second flap and said arms defining a key way for disposing said key in a manner such that said flaps grip said key;

said key frame being constructed of a substantially rigid, resilient material whereby said first and said second arm may be urged away from one another for inserting said deadbolt key into said U-shaped cavity in a manner such that said key is rigidly held therebetween.

7. The remote control door lock system of claim 6, further including:

a power cord having a female connector end connectable to said male electrical connector of said rechargeable battery pack and a male connector end connectable to an electrical source for recharging said rechargeable battery pack.

* * * * *